US006558466B2

(12) United States Patent
Hanumanthu et al.

(10) Patent No.: US 6,558,466 B2
(45) **Date of Patent: *May 6, 2003**

(54) APPARATUS FOR COATING A WEB

(75) Inventors: Ramasubramaniam Hanumanthu, Rochester, NY (US); Rukmini B. Lobo, Webster, NY (US); Barry A. Fitzgerald, Holley, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/465,202

(22) Filed: Dec. 15, 1999

(65) Prior Publication Data

US 2002/0174830 A1 Nov. 28, 2002

(51) Int. Cl.[7] ..... B05C 1/06
(52) U.S. Cl. ..... 118/261; 118/212; 101/157
(58) Field of Search ..... 101/145, 157, 101/167, 169, 350.5, 350.6; 15/256.5, 256.51; 118/261, 212, 249

(56) References Cited

U.S. PATENT DOCUMENTS

| | | | | |
|---|---|---|---|---|
| 2,185,223 A | | 1/1940 | Paynter | |
| 3,353,517 A | | 11/1967 | Tower | |
| 3,361,059 A | * | 1/1968 | Klingler | |
| 3,749,054 A | | 7/1973 | Brezinski | |
| 4,158,333 A | | 6/1979 | Navi | |
| 4,373,443 A | | 2/1983 | Matalia et al. | |
| 4,615,295 A | * | 10/1986 | Wittkopf | 118/261 |
| 5,755,883 A | | 5/1998 | Kinose et al. | |

FOREIGN PATENT DOCUMENTS

| | | |
|---|---|---|
| AT | 392 742 B | 5/1991 |
| DE | 22 64 119 A | 7/1974 |
| DE | 84 01 569 U | 7/1988 |
| DE | 93 14 292 U | 1/1994 |
| WO | 97 38797 A | 10/1997 |

OTHER PUBLICATIONS

Pocket Pal, International Paper Co. (1983) pp. 26–28.*

* cited by examiner

*Primary Examiner*—Brenda A. Lamb
(74) *Attorney, Agent, or Firm*—Clyde E. Bailey, Sr.

(57) ABSTRACT

An apparatus for coating a web of indeterminate length has a coating element comprising a liquid deflector member for diverting liquid away from a coating surface. The liquid deflector member is arranged beneath a blade member that removes excess coating liquid from the coating surface. Excess coating liquid follows a path away from the coating surface and down the liquid deflector member thereby avoiding contamination of the coating surface.

9 Claims, 12 Drawing Sheets

APPARATUS FOR COATING A WEB

CROSS-REFERENCE TO RELATED APPLICATIONS

The present application is related to U.S. application Ser. No. 09/461,964, filed Dec. 15, 1999, by Ramasubramaniam Hanumanthu, et al., and entitled, "Element For Deflecting Excess Liquid From A Coating Surface."

FIELD OF THE INVENTION

The invention relates generally to the field of roller/gravure coating. More particularly, the invention concerns a coating apparatus that meters a film of liquid coating solution from a coating surface or roller and then diverts it away, thereby preventing contamination of the coating surface.

BACKGROUND OF THE INVENTION

In conventional roller/gravure coating processes (as described, for example, in U.S. Pat. No. 4,373,443, Feb. 15, 1983, by Matalia et al., entitled, "Method Of High Viscosity Inking In Rotary Newspaper Presses" where a gravure cylinder provides ink in newspaper presses), a liquid coating composition is directed to the surface of a coating applicator roll 1 by one of several suitable means including rotating (denoted by arrow) the applicator roll 1 through a reservoir 2 of liquid 3, as illustrated in FIG. 1. The surface of the coating applicator roll 1 may have a smooth finish or it may be engraved with cells/grooves 5 of prescribed volume. Often, the layer of liquid 3 picked up by the applicator roll 1 from the reservoir 2 is subsequently metered to a thinner film using a doctor blade 4. In gravure coating, for example, the doctor blade 4 removes all the applied liquid except that which is present in the engraved cells 5 formed in the gravure cylinder 1. Alternatively, the steps of wetting (filling) and doctoring may also be combined as described in U.S. Pat. No. 4,158,333, Jun. 19, 1979, by Navi, titled, "Inking Baffle For Rotary Newspaper Presses." After the doctoring step, the liquid remaining on the surface of a smooth coating applicator roll or that remaining in the cells 5 of an engraved coating applicator roll is transferred to a moving web 6 by impressing the moving web 6 between the applicator roll 1 and a soft backer or impression roll 7. In FIG. 1, the web 6 is shown to be moving in the same direction as the surface of the coating applicator roll 1 at the point of contact between the two, but in roller/gravure coating practice, the web may be conveyed in the opposite direction as well. The thickness of coating transferred to the moving web 6 is generally a known fraction of the thickness of liquid film retained on the surface of a smooth coating applicator roll downstream of the doctoring step or, alternatively, it is a known fraction of the volume of the engraved cells 5 per unit surface area of an engraved coating applicator roll 1.

Depicted in FIGS. 2*a* and 2*b* , a shortcoming of existing roller/gravure coating processes is that when excess liquid 8 removed by the doctor blade 4 falls back on the surface of the coating applicator roll 1, it is carried back up to the "bank" of coating liquid 9 that is accumulated between the moving coating applicator roll 1 surface and the stationary doctor blade 4. Since the excess liquid 8 falls back on and contacts the surface of the coating applicator roll 1 in a turbulent and random manner, this renders the bank of coating liquid 9 uneven in the cross-web direction. The unevenness of the bank of coating liquid 9 in turn causes a coating defect in the form of streaks and bands 10, as exemplified in FIG. 3. The defect is especially prominent in particulate coating dispersions (as opposed to solutions).

An analysis of the nature of the flow of metered liquid 3 behind the doctor blade 4 reveals that at low coating applicator roll 1 surface speeds the liquid 3 simply runs back down the surface of the coating applicator roll 1 in a laminar fashion (see flow lines 11 in FIG. 4*a*). However, as speed of the coating applicator roll 1 is raised, a point is reached when the metered liquid 3 separates from the surface of the coating applicator roll 1 and flows (see flow lines 12 in FIG. 4*b*) generally along the underside 13 of doctor blade 4 and away from the surface of the applicator roll 1.

Moreover, at some point further downstream of the contact point 14 between the doctor blade 4 and the coating applicator roll 1, the deflected liquid loses its momentum and therefore separates from the underside surface 13 of the doctor blade 4 and falls or flows vertically downwards under the influence of gravity (refer to FIG. 4*b*).

Presently the defect can be avoided in one of several ways. One way known to avoid this defect is to maintain the coating speed below the speed of transition from "runback" flow to "deflected" flow. Experimental observations indicate that the speed of transition between runback flow (FIG. 4*a*) and deflected flow (FIG. 4*b*) depends on operating parameters—viscosity and surface tension of liquid; tangent angle between doctor blade 4 and surface of the coating applicator roll 1; thickness of the incoming film of liquid; radius of coating applicator roll 1; etc. Here, runback flow is defined as the case where liquid removed by the doctor blade 4 runs back down the surface of the coating applicator roll 1. Deflected flow is where the excess liquid 8 metered by the doctor blade 4 travels away from the surface of the coating applicator roll 1, along the underside 13 of the doctor blade 4, up to a point where it loses its momentum, and then further separates from the underside 13 of the doctor blade 4 surface, and drops vertically under the influence of gravity.

Unfortunately, under normal operating/manufacturing conditions, the speed of transition from runback to deflected flow is too low for it to be a practicable production speed.

Referring to FIGS. 5*a* and 5*b* , another known way to avoid the defect is to locate the contact point or tip 14 of the doctor blade 4 at application points on the cylindrical coating applicator roll 1 surface that are far from top-dead-center 19. Then, especially in the case of small diameter cylinders, i.e., typically diameters less than about 5 inches, the deflected excess liquid 8 in all likelihood will not flow back to the cylindrical coating applicator roll 1 surface on its way down (refer to FIG. 5*b*). But at application points close to top-dead-center 19, and with large diameter coating applicator rolls 1, the excess liquid 8 will tend to flow back to the surface of the coating applicator roll (FIG. 5*a*).

Unfortunately, the location of the contact point or tip 14 of the doctor blade 4, relative to top-dead-center 19 cannot be changed arbitrarily. For instance, to minimize evaporation of coating liquid 3 from the surface of the coating applicator roll 1 in the region between the contact point or tip 14 of the doctor blade 4 and top-dead-center 19, it may be necessary to narrowly fix the distance of the contact point or tip 14 of the doctor blade 4 from top-dead-center 19. Similarly, the diameter of the coating applicator roll 1 may also have to be narrowly fixed. This is true, for instance, in the coating of discrete patches or patterns using gravure coating, wherein the ratio of gravure cylinder circumference to engraved patch/pattern length has to be maintained constant.

While there are no known prior art attempts to solve Applicants' specific problem of diverting coating liquid from the surface of a coating applicator roll having an excess quantity of liquid thereon, U.S. Pat. No. 5,755,883, May 26, 1998, by Kinose et al., titled, "Roll Coating Device For Forming A Thin Film Of Uniform Thickness" discloses a roll coater having a blade scraper for scraping coating liquid from a metal roll and a tray positioned beneath the nip for catching the scraped liquid. This device provides only for preventing fluid from contacting coating elements beneath the nip and does not protect the roll from which the liquid was deposited from receiving excess liquid.

An attempt to use a similar tray in a location between the underside 13 of the doctor blade 4 and the surface of the coating applicator roll 1 (refer to FIG. 6) was not successful because there is very little room available there. Indeed the deflected excess liquid 8 separates from the underside 13 of the doctor blade 4 so quickly that the lip 20 of the tray 21 would have to be within 0.32 cm (0.125 in) from the underside surface 13 of the doctor blade 4, and the applicator roll 1 surface. Such tight gaps are not favored in manufacturing environments.

Yet another scheme to prevent the defect involves the creation of a narrow passageway 22 between the coating applicator roll 1 surface and an element 23. The coating liquid 3 effectively "floods" the passageway 22 and in this manner defects that persist far upstream of the contact point or tip 14 of doctor blade 4 are forced to damp out before they reach the contact point or tip 14 of doctor blade 14. In other words, the pressure in the "bank" of coating liquid 9 accumulated between the moving coating applicator roll 1 surface and the stationary doctor blade 4 stays even across the width of the web 6, at least in the vicinity of the doctor blade tip 14. However, the drawback of this approach was that to effectively flood the passageway 22 under all operating conditions, the element 23 had to be maintained at gaps less than 0.2 cm (0.08 in) from the coating applicator roll 1 surface. Again, such narrow gaps are not favored in the manufacturing environment.

Finally, the problem may be inherently solved by using combined feed/blading units, such as the reverse doctor pond feed (U.S. Pat. No. 4,158,333). There, the trailing blade at the exit of the reservoir keeps the excess fluid within the reservoir, and hence there is no occasion for deflection ("deflection" is illustrated in FIG. 4*b*). However, in the present application, reverse doctor pond feed is not practicable.

Therefore, there persists a need for a roller/gravure coating process in which excess coating liquid material removed by a doctor blade is diverted away from the surface of the coating applicator roll thereby avoiding contamination of the applicator roll surface.

SUMMARY OF THE INVENTION

It is, therefore, an object of the invention to provide a roller/gravure coating apparatus having a liquid metering/diverting element for metering a film of liquid material from the surface of a coating applicator roll and then diverting excess liquid material away from the surface of the coating applicator roll.

An important feature of the invention is a liquid deflector member arranged proximate to the surface of the coating applicator roll and a metering member for diverting excess liquid away from the coating applicator roll surface.

To solve this and other objects of the invention, there is provided an apparatus for coating a web of indeterminate length, comprising a source of coating composition; an engraved cylinder at least partially in fluid contact with the source of coating composition. The engraved cylinder includes a plurality of cells for collecting coating composition therein and then transfers the coating composition to the web of indeterminate length. An impression cylinder is in rotating contact with the engraved cylinder, which thereby forms a web transfer path therebetween. The web of indeterminate length is advanced through the web transfer path so that coating composition in plurality of cells transfers to the web of indeterminate length forming an applied coat of coating composition on the web of indeterminate length. The apparatus also comprises a coating element for doctoring the applied coat of coating composition on the web of indeterminate length to a finished coat and then diverting any excess coating composition away from said engraved cylinder.

It is an advantageous effect of the invention that the liquid deflector member is versatile, cost effective to manufacture, simple to install and operate and can function with minimum variability of settings over a wide range of manufacturing operating conditions

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
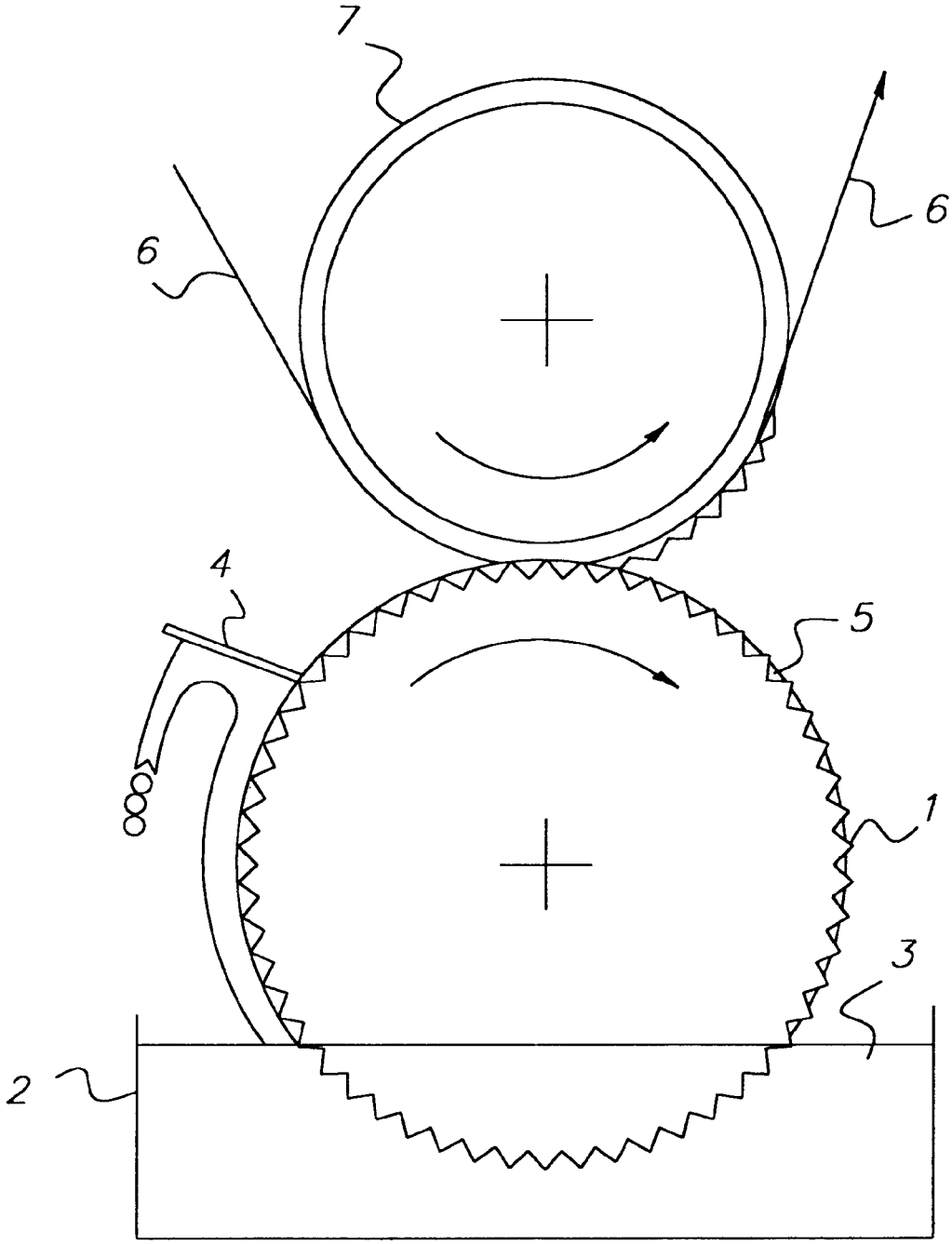
FIG. 1 PRIOR ART
FIG. 1 is a front elevation view of a prior art roller/gravure coating process.
Figure 2A:
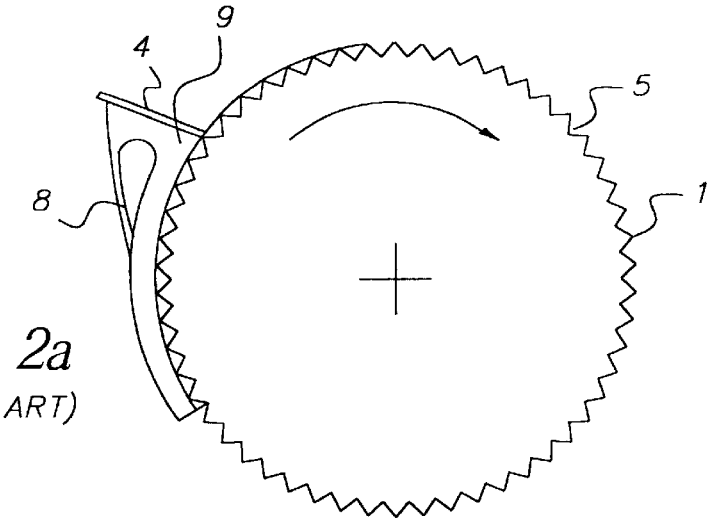
FIG. 2a (PRIOR ART)
FIG. 2*a* is a schematic illustration of a partial cross-sectional side view of a prior art roller/gravure coating process illustrating doctored sheet of coating liquid flowing downwardly onto the surface of a coating applicator roll.
Figure 5A:
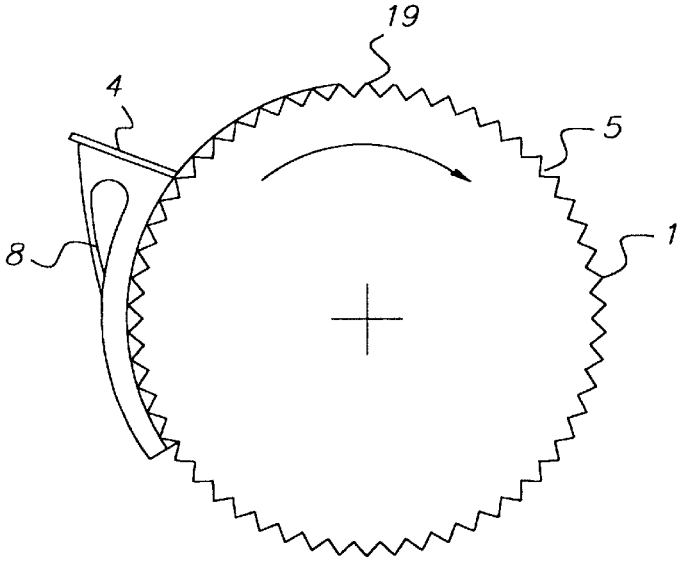
FIG. 5a (PRIOR ART)
FIG. 5*a* is a schematic of a prior art roller/gravure coating process illustrating deflected sheet of coating liquid separating from underside of doctor blade and flowing downwardly onto the surface of a coating applicator roll.
Figure 5B:
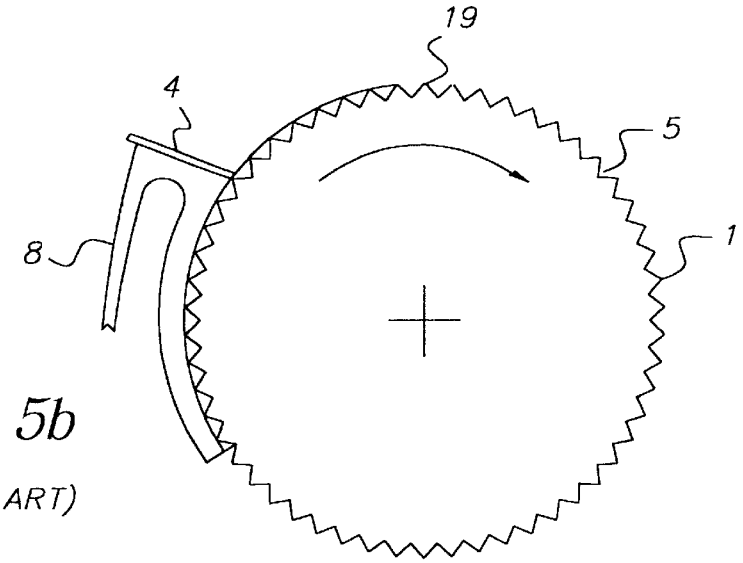
FIG. 5b (PRIOR ART)
FIG. 5*b* is a schematic of a prior art roller/gravure coating process illustrating deflected sheet of coating liquid separated from the doctor blade and the surface of a coating applicator roll.
Figure 2B:
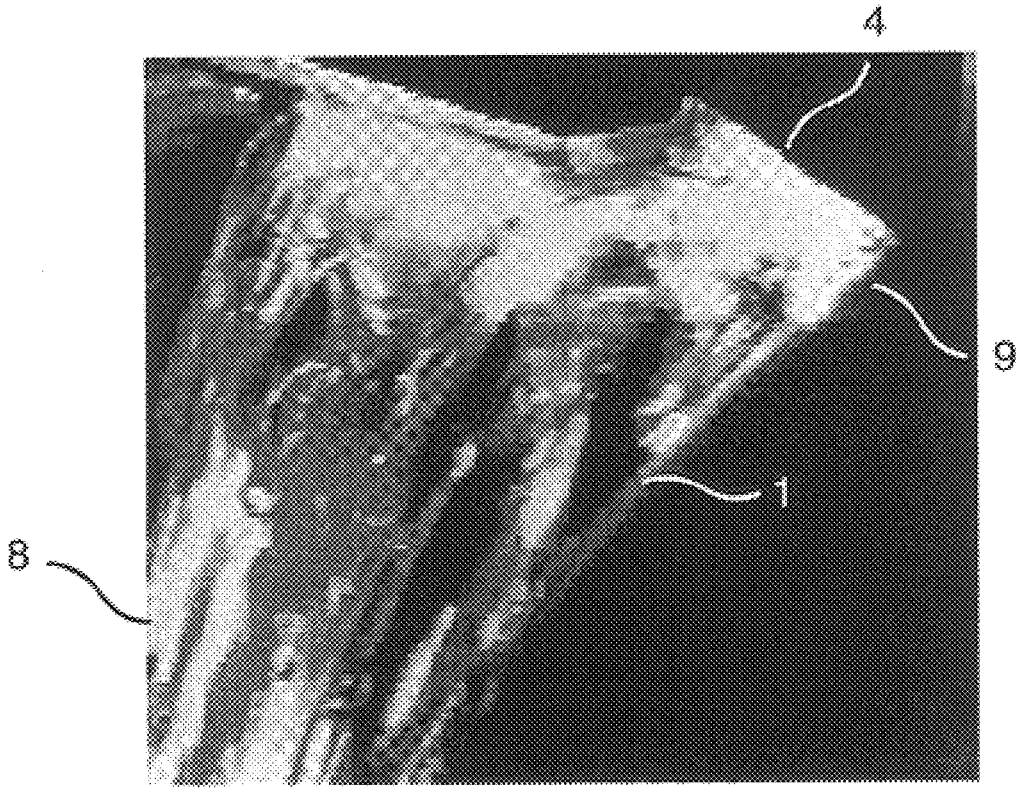
Fig. 2b (Prior Art)
FIG. 2*b* is a scanned photographic image of a partial cross-sectional side view of a prior art roller/gravure coating process illustrating doctored sheet of coating liquid flowing downwardly onto the surface of a coating applicator roll.
Figure 3:
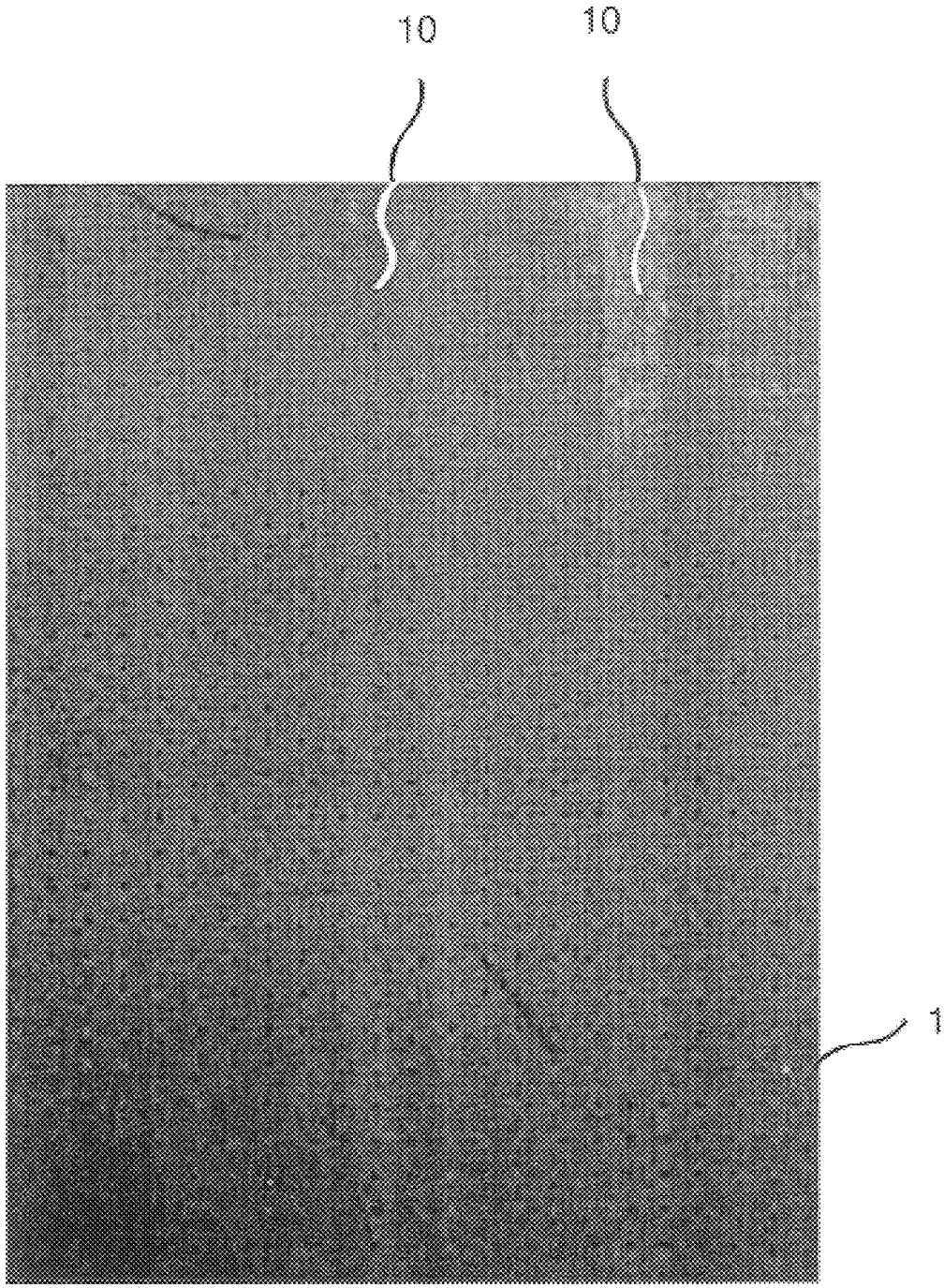
Fig. 3 (Prior Art)
FIG. 3 is a scanned image of a coating sample illustrating defects in the form of streaks and bands of a prior art roller/gravure coating process.
Figure 4A:
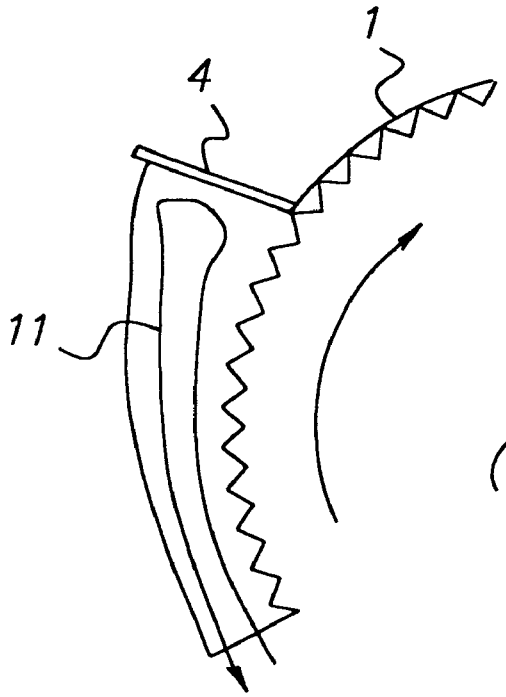
FIG. 4a (PRIOR ART)
FIG. 4*a* is a schematic of a roller/gravure coating process illustrating flow of excess coating liquid running back down the surface of a coating applicator roll.
Figure 4B:
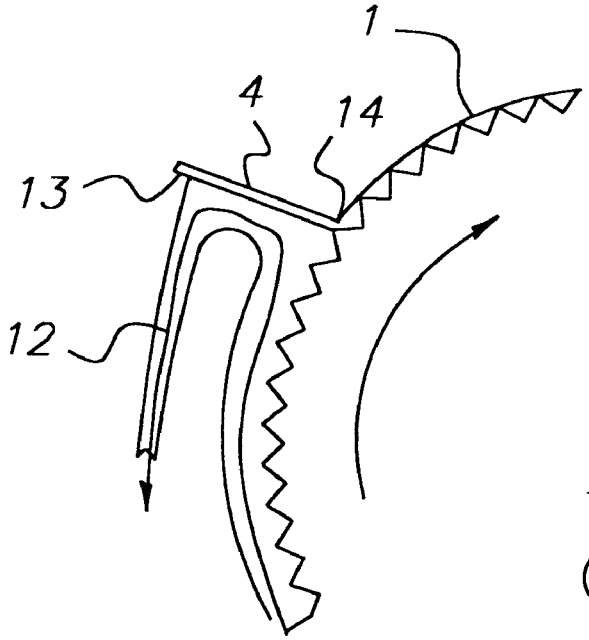
FIG. 4b (PRIOR ART)
FIG. 4*b* is a schematic of a roller/gravure coating process illustrating deflected flow of excess coating liquid along the underside of a doctor blade member.
Figure 4C:
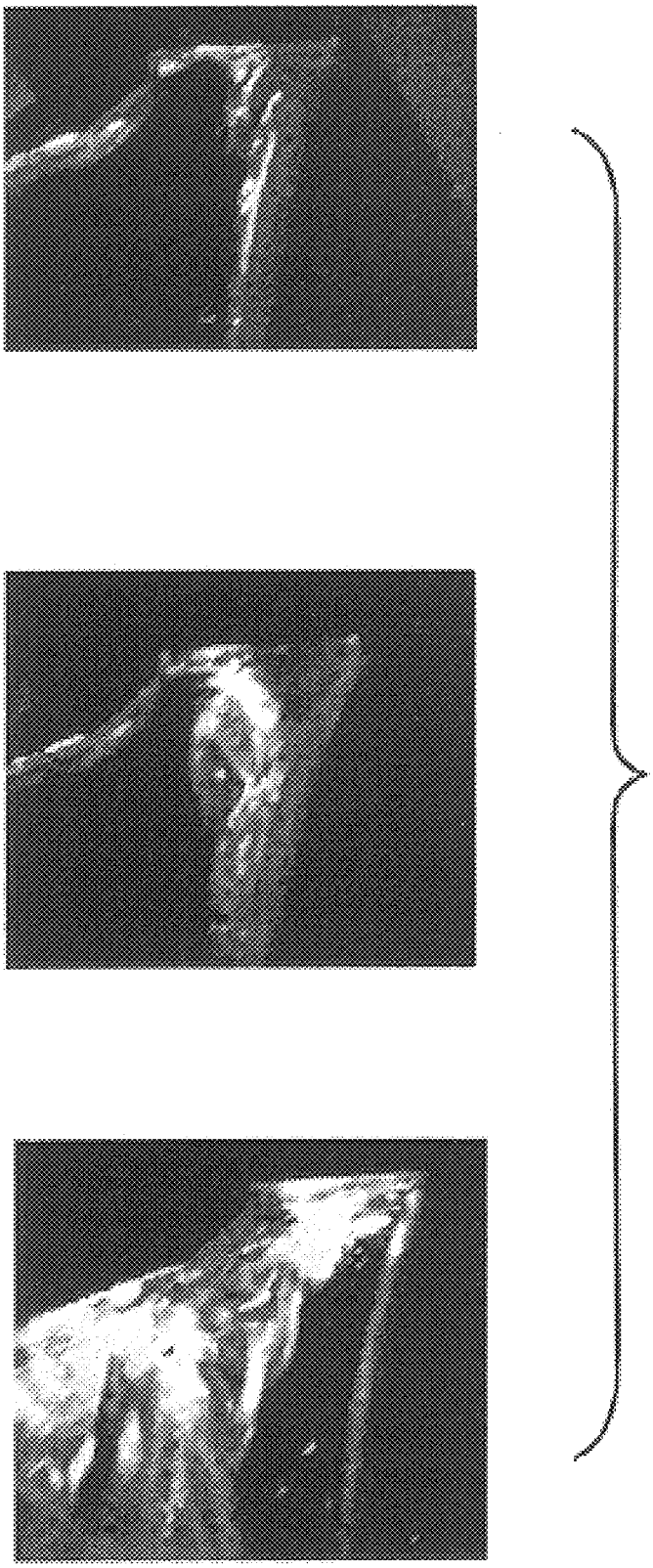
Fig. 4c (Prior Art)
FIG. 4*c* is a scanned image of photographic snapshots depicting the transition of flow behind the blade from "runback" to "deflected" modes. The top and bottom pictures images in this column are the counterparts of the schematic illustrations in FIGS. 4*a* and 4*b*, respectively.
Figure 6:
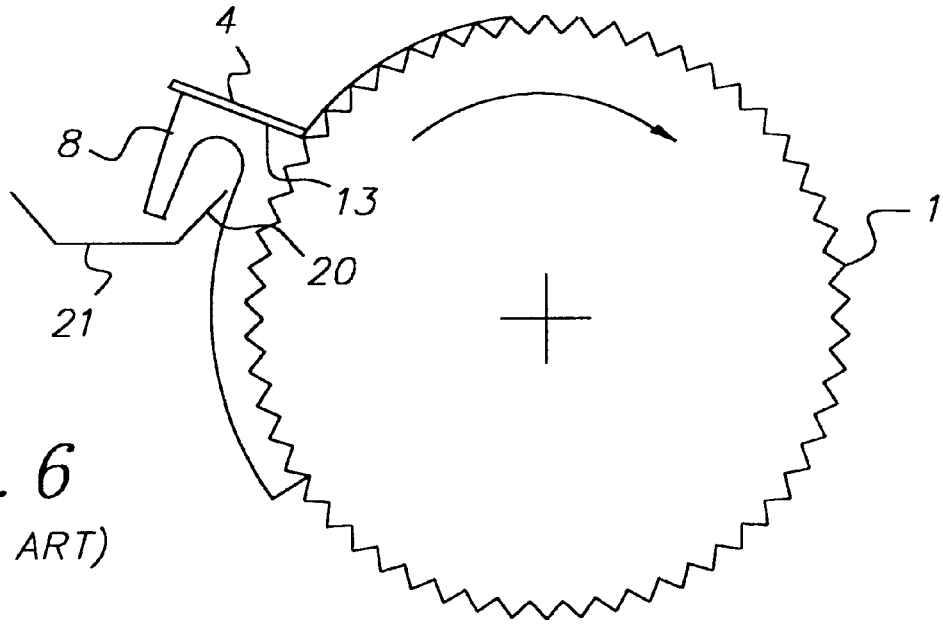
FIG. 6 (PRIOR ART)
FIG. 6 is a schematic of a prior art element to catch the deflected sheet of liquid after separation from the doctor blade.
Figure 7:
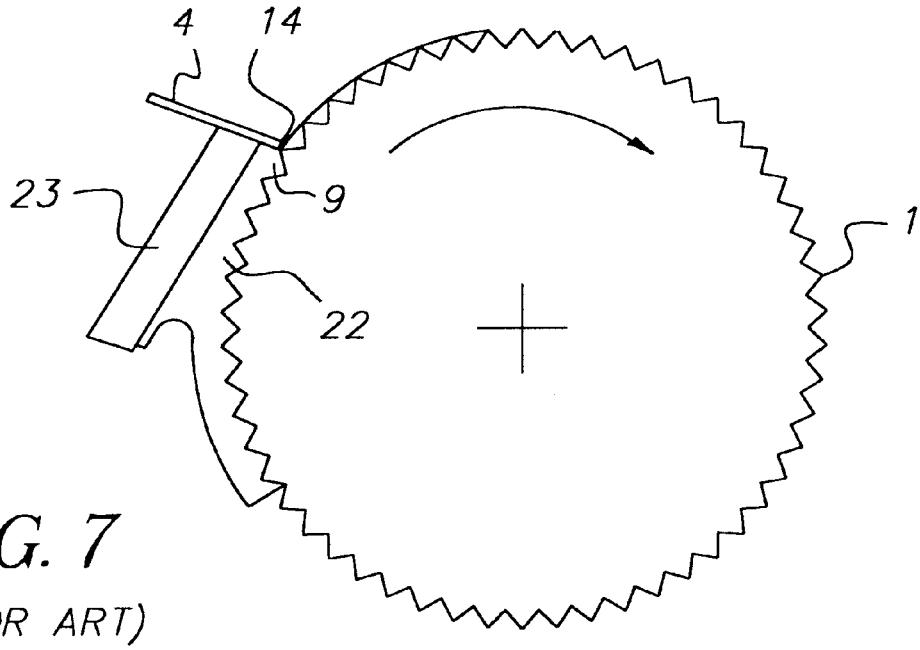
FIG. 7 (PRIOR ART)
FIG. 7 is a schematic of another prior art element to flood the passageway between the surface of a coating applicator roll and said element in an attempt to maintain an even bank of coating liquid at the tip of the blade.

Turning now to the drawings, and in particular to FIGS. 8*a*–10, there is illustrated the coating element 25 according to the principles of the invention. According to FIGS. 8*a* and 8*b*, coating element 25 removes excess liquid (l) from the surface 27 of a coating applicator, such as a roll 24, and then diverts the excess liquid (l) away from the surface 27. Importantly, coating element 25 has a doctor blade member 26 and a liquid deflector member 28 structurally disposed in a support member 30.

Referring to FIGS. 8*a*–11, doctor blade member 26, generally has an active end 32 extending from the support member 30 for engaging and removing excess liquid (l) from the surface 27 of coating applicator or roll 24. Support member 30 is used principally to manipulate and fix the orientation of the active end 32 relative to the surface 27 of the coating applicator or roll 24. Thus, for most efficient operation, active end 32 of doctor blade member 26, and more particularly, underside 34, is arranged preferably at a predetermined angle $\theta_t$ with the surface 27 of the coating applicator or roll 24. The inventors have determined that a preferred range of predetermined angle $\theta_t$ is between about 50–60 degrees. Skilled artisans will appreciate that the active end 32 of the doctor blade member 26 contacts the surface 27 of the coating applicator or roll 24 at some well defined point P so that excess coating liquid (l) can be effectively removed from the surface 27.

Figure 8A:
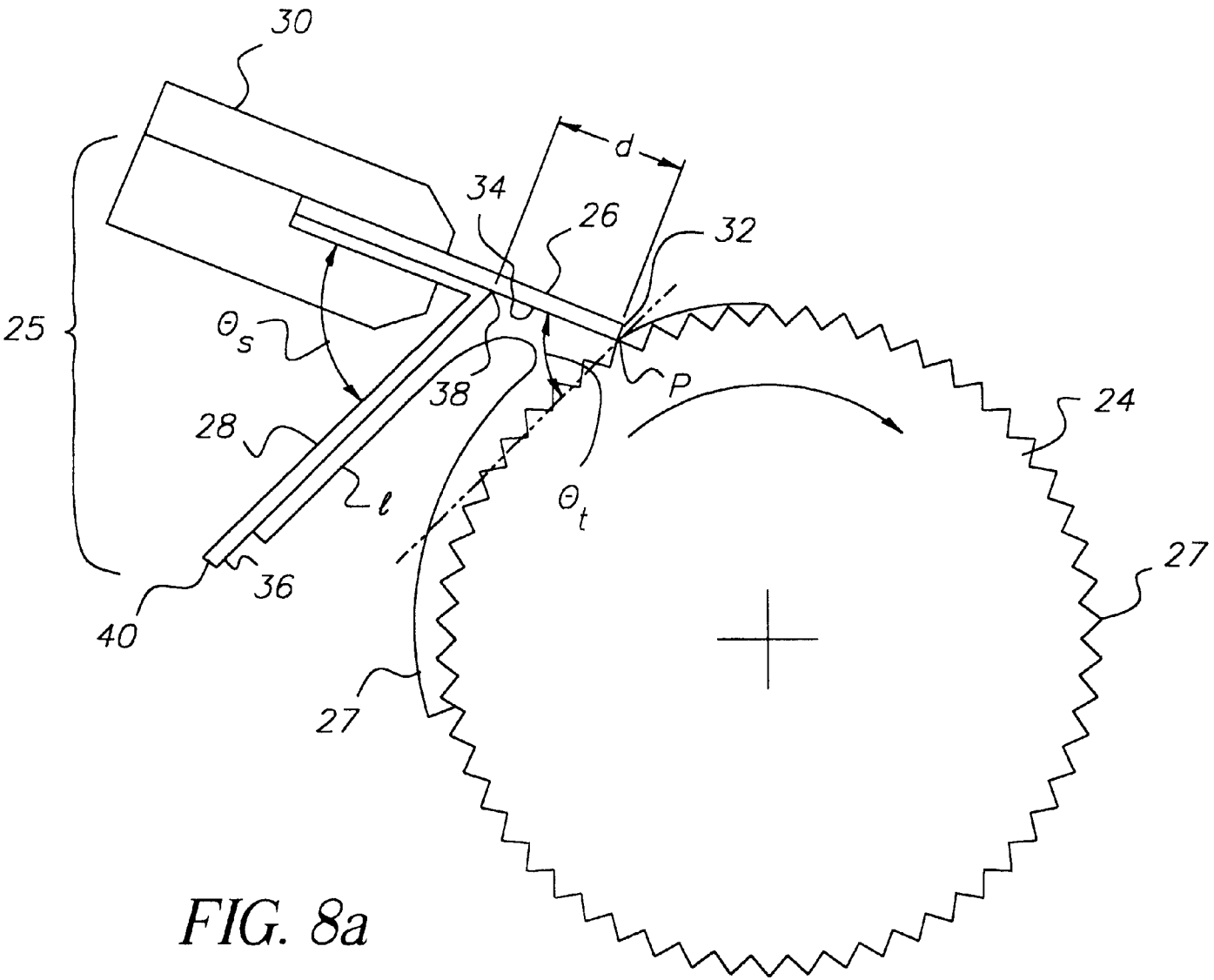
FIG. 8*a* is a schematic of the element of the invention illustrating orientation with respect to the surface of the coating applicator roll and metering doctor blade.
Figure 8B:
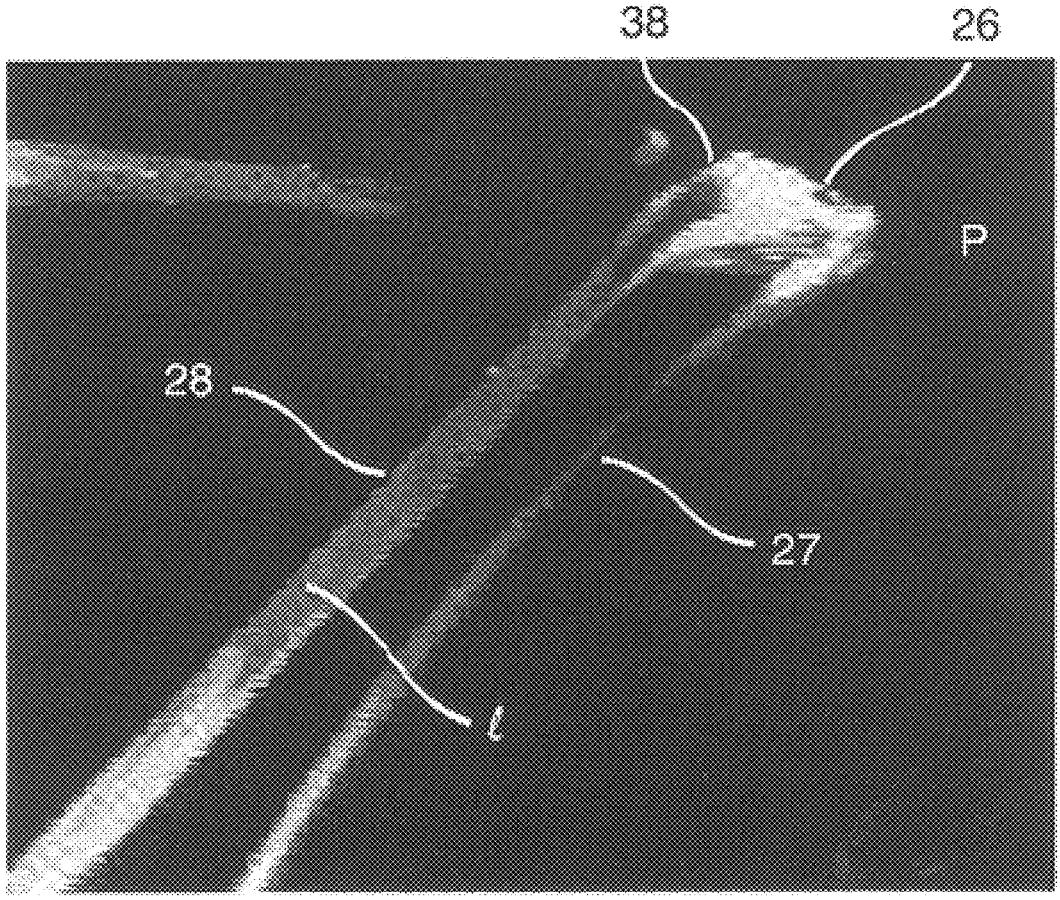
FIG. 8*b* is a scanned image of an application of the invention.
Figure 9:
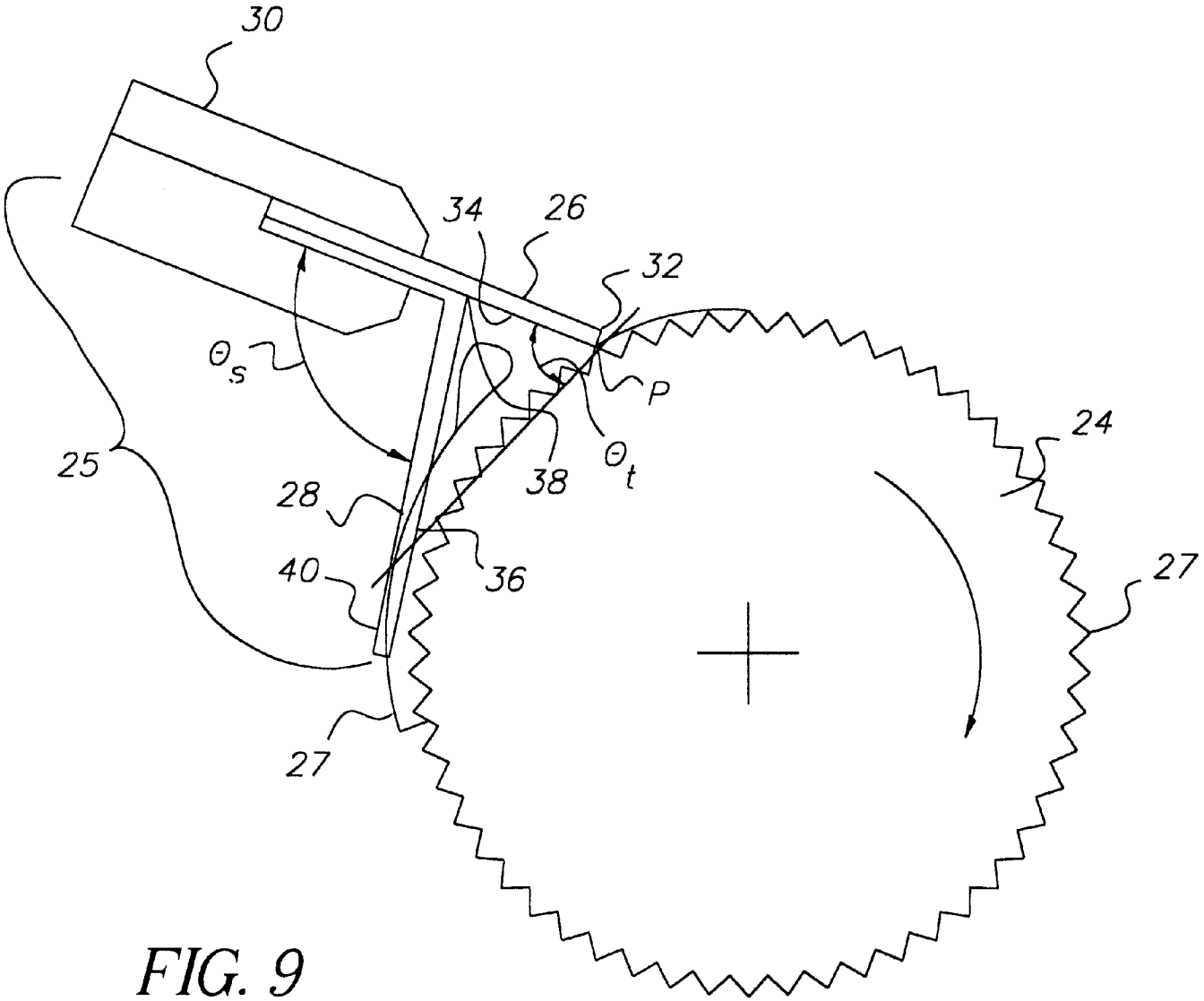
FIG. 9 is a schematic of the element of the invention illustrating an unfavorable orientation of liquid deflector member; and, FIGS. 10*a* , 10*b*, and 11 are schematics of the element of the invention illustrating alternative embodiments.
Figure 10A:
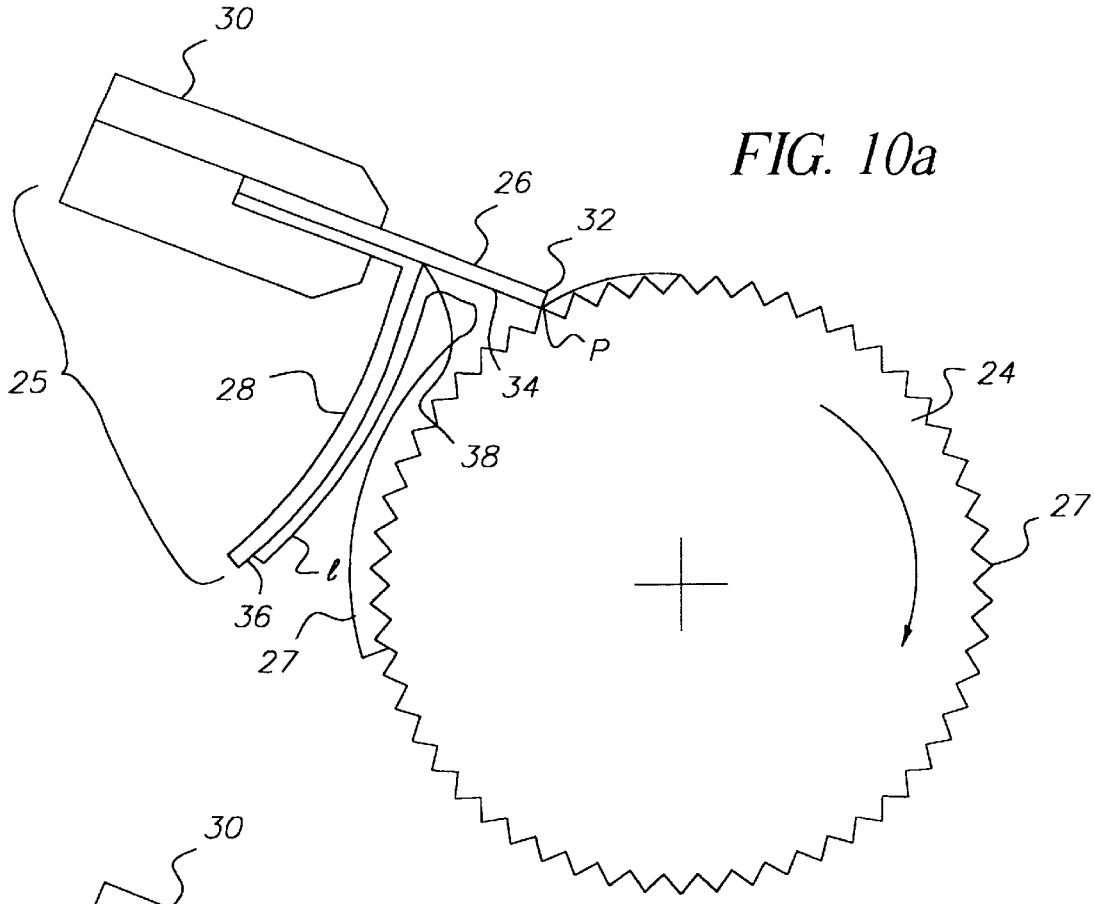
Figure 10B:
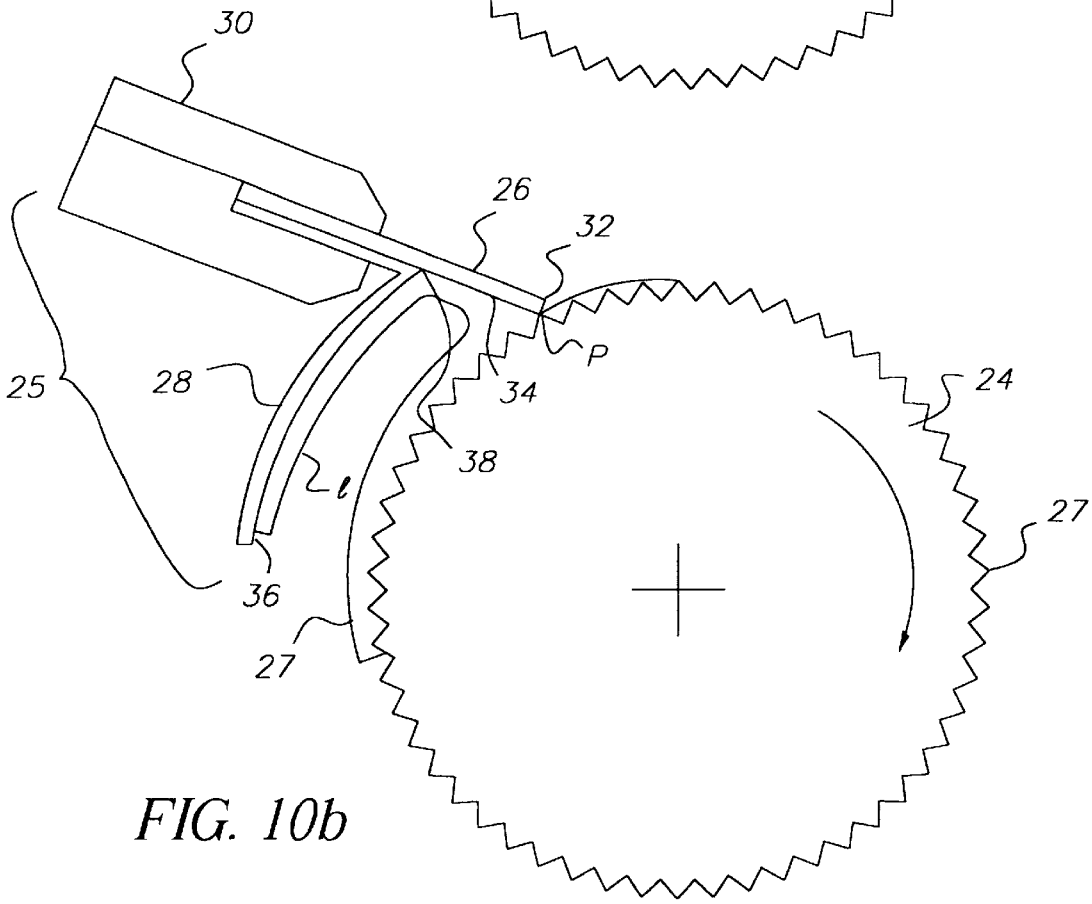

Referring to FIGS. 8*a*–11, liquid deflector member 28 has an active face 36 (if properly oriented) that diverts excess coating liquid (l) away from the surface 27 of the coating applicator or roll 24. Thus, excess coating liquid (l) doctored from the surface 27 of coating applicator or roll 24 flows along the underside 34 of active doctor blade member 26 and then along active face 36 of liquid deflector member 28 away from surface 27. Active face 36 is positioned proximate to both the active end 32 of the doctor blade member 26 and the surface 27 of the coating applicator or roll 24. The underside 34 of doctor blade member 26 extends from the contact point P to apex 38 by a predetermined clearance (d), described further below. Apex 38 is a point on the underside 34 of blade member 26 that intersects the active face 36 of the liquid deflector member 28. Further, active face 36 of liquid deflector member 28 is arranged at a predetermined angle $\theta_s$ to the underside 34 of the active end 32 of doctor blade member 26. In the preferred embodiment, active face 36 of liquid deflector member 28 is generally planar (FIG. 8*a*). Alternately, active face 36 may be generally contoured from a point near apex 38 either away (FIG. 10*a*) from the surface 27 of coating applicator or roll 24 or towards (FIG. 10*b*) the surface 27 of coating applicator or roll 24. Each of these configurations has proven effective in diverting excess liquid (l) away from surface 27.

Referring again to FIG. 8*a* , the underside 34 of doctor blade member 26 preferably makes a generally obtuse angle with the adjoining active face 36 of the liquid deflector member 28. Thus, excess liquid (l) will follow a generally obtuse angular path from the underside 34 of the doctor blade member 26 along the active face 36 of the liquid deflector member 28.

Figure 11:
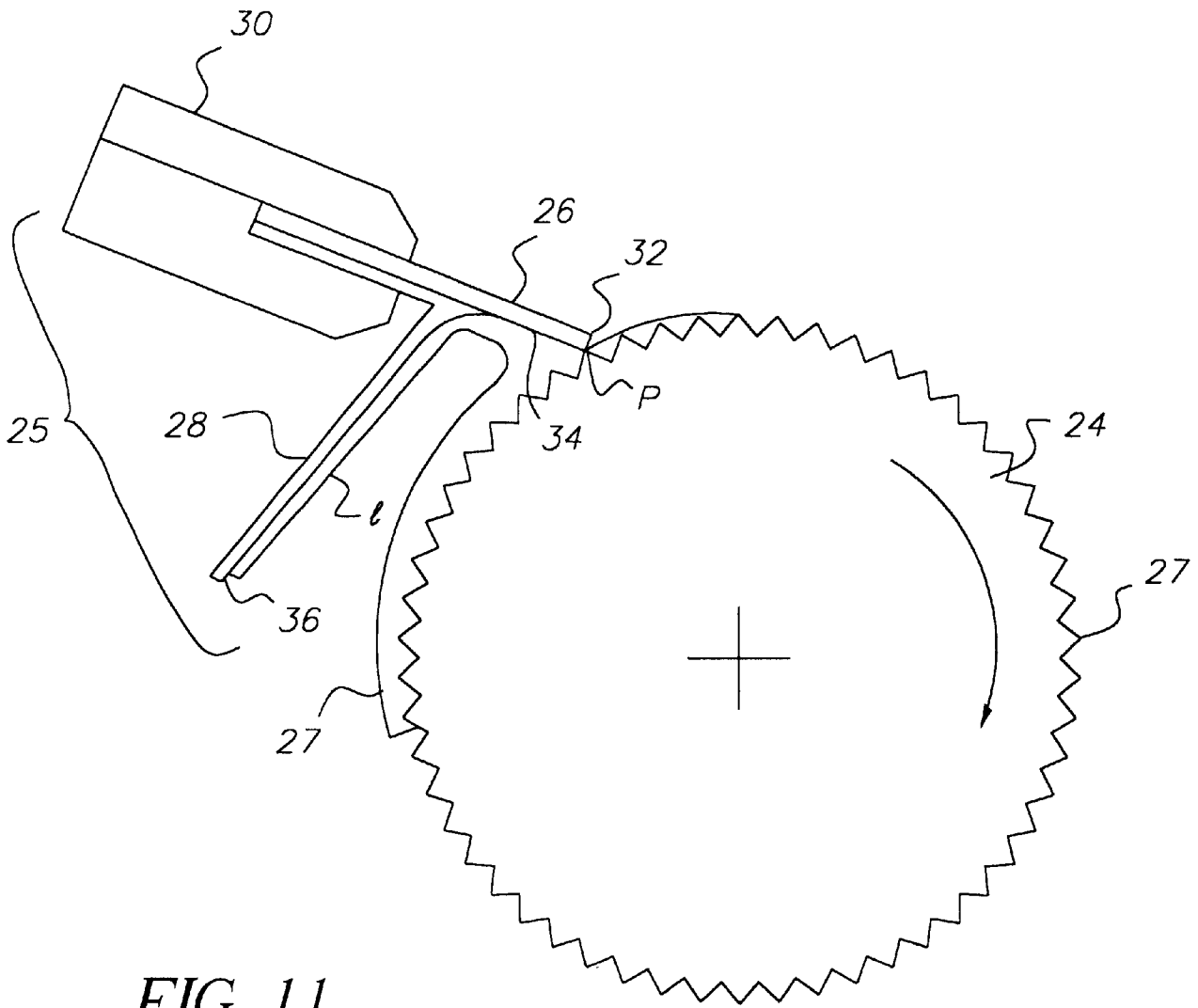

Referring now to FIG. 11, alternatively, the underside 34 of doctor blade member 26 may form a generally arcuate path with the active face 36 of the liquid deflector member 28 along which excess liquid (l) flows.

Referring again to FIGS. 8*a* and 8*b* , liquid deflector member 28 is adjustably fixed to support member 30 with active face 36 positioned close enough to the contact point P that it "captures" the deflected liquid (l) flowing on the underside 34 of doctor blade member 26. The positioning is important because the deflected liquid (l) could very well lose its momentum and then divert downwardly under the influence of gravity towards surface 27 of the coating applicator or roll 24.

Liquid deflector member 28, preferably made of a rigid metal or plastic, may be structurally affixed to support member 30 in several ways with virtually the same results, including bolting, screwing, riveting, welding, or clamping.

Referring again to FIGS. 8*a* and 8*b* , there are several important operating constraints on the design of the liquid deflector member 28. According to FIG. 8*a* , the angle $\theta_s$ that the liquid deflector member 28 makes with the underside 34 of the doctor blade member 26 is optimum when the active face 36 of the deflector member 28 is near normal to the doctor blade member 26. However, in this configuration, there is a high risk that a liquid deflector member 28 having a rather long length might interfere with the rotating surface 27 of coating applicator or roll 24. Consequently, our experience indicates that a preferred angle $\theta_s$ is one that is equal to the tangent angle $\theta_t$. When $\theta_s$ is less than $\theta_t$, full advantage is not taken of the assist that gravity provides to the flow of deflected liquid (l) down the active face 36 of deflector member 28 away from the surface 27 of coating applicator or roll 24. On the other hand, if $\theta_s$ is much larger than $\theta_t$, there is a rather high risk that the bottom edge 40 of the liquid deflector member 30 might interfere with the surface 27 of the coating applicator or roll 24 further upstream of the doctor blade member 26 (refer to FIG. 9).

Referring to again FIG. 8*a*, as indicated, it is also important that the underside 34 of doctor blade member 26 have a predetermined clearance (d), i.e., distance between the apex 38 and the contact P. For a given inclination, $\theta_t$ of blade member 26 above the horizontal plane, this optimum predetermined clearance (d) depends on the flow rate of deflected liquid (l) (per unit width of coating), q; viscosity of coating liquid, $\mu$; density of coating liquid, $\rho$; and gravitational acceleration, g: clearance $$\propto \left(\frac{q^2}{g}\right)^{1/3} \cdot f,$$

where f is a monotonically increasing function of the Reynolds' Number (Re), given by $$Re \equiv \frac{q\rho}{\mu}.$$

In the preferred embodiment, an effective clearance (d) is one in the range of about 0.64 cm (0.25 in) to about 1.9 cm (0.75 in).

The invention has been described with reference to a preferred embodiment. However, it will be appreciated that variations and modifications can be effected by a person of ordinary skill in the art without departing from the scope of the invention.

PARTS LIST:

| | |
|---|---|
| 1 | excess coating liquid |
| P | point of contact |
| 1 | coating applicator roll |
| 2 | reservoir or pan |
| 3 | liquid or coating liquid |
| 4 | doctor blade |
| 5 | .engraved cells/grooves |
| 6 | web |
| 7 | soft backer or impression roll |
| 8 | excess liquid |
| 9 | bank of coating liquid |
| 10 | streaks and bands |
| 11 | flow line |
| 12 | flow line |
| 13 | underside of doctor blade 4 |
| 14 | contact point or tip of doctor blade 4 |
| 19 | top-dead-center of cylindrical surface of coating applicator roll 1 |
| 20 | lip of tray 21 |
| 21 | tray |
| 22 | narrow passageway |
| 23 | element |
| 24 | coating applicator or roll |
| 25 | coating element |
| 26 | doctor blade member |
| 27 | surface of coating applicator |
| 28 | liquid deflector member |
| 30 | support member of coating element 25 |
| 32 | active end of doctor blade member 26 |
| 34 | underside of doctor blade member 26 |
| 36 | active face of liquid deflector member 28 |
| 38 | apex |
| 40 | bottom edge of liquid deflector member 28 |

What is claimed is:

1. Apparatus for coating a web of indeterminate length, comprising:

a source of coating composition;

an engraved cylinder at least partially in fluid contact with said source of coating composition, said engraved cylinder having a plurality of cells for collecting coating composition therein and then transferring said coating composition to said web of indeterminate length;

an impression cylinder in rotating contact with said engraved cylinder, said impression cylinder and said engraved cylinder forming a web transfer path therebetween;

means for advancing said web of indeterminate length through said web transfer path so that coating composition in said plurality of cells transfers to said web of indeterminate length forming an applied coat of coating composition on said web of indeterminate length; and, a coating element arranged in an upper region and along a circumferential portion of the engraved cylinder proximate to a dead center point on the engraved cylinder, said coating element comprising a blade member and a liquid deflector member, wherein said blade member having one end disposed in an element support member and an active end extending from said element support member for engaging said engraved cylinder, said blade member being arranged at a predetermined angle $\theta_t$ with said engraved cylinder and having a point of contact therewith and wherein said liquid deflector member having one end disposed directly adjacent said one end of said blade member in said element support member and an opposite end with an active face arranged proximate to said contact point of said blade member, extending downwardly and away from said blade member such that said active face is inclined at a predetermined angle $\theta_s$ relative to said active end of said blade member such that said predetermined angle $\theta_s$ is equal to or greater than said predetermined angle $\theta_t$ thereby resulting in the excess coating doctored by said blade member from said engraved cylinder being captured by said deflector member.

2. The apparatus recited in claim 1 wherein said active face of said liquid deflector member is generally contoured away from said engraved cylinder.

3. The apparatus recited in claim 1 wherein said active face of said liquid deflector member is generally contoured towards said engraved cylinder.

4. The apparatus recited in claim 1 wherein said active face of said liquid deflector member is generally planar.

5. The apparatus recited in claim 1 wherein an underside of said blade member extends from said point of contact to an active face of said liquid deflector member, said underside defining a predetermined clearance.

6. The apparatus recited in claim 5 wherein said predetermined clearance for a predetermined inclination $\theta_h$, is predicted by the relationship: clearance $$\propto \left(\frac{q^2}{g}\right)^{1/3} \cdot f,$$

wherein: f is a monotonically increasing function of the Reynolds' Number (Re), given by $$Re \equiv \frac{q\rho}{\mu};$$

q is flow rate of deflected liquid (per unit width of coating); $\mu$ is viscosity of coating liquid; ρ is density of coating liquid; and g is acceleration due to gravity.

7. The apparatus recited in claim 5 wherein said predetermined clearance is in the range between about 0.64 cm (0.25 in) and 1.9 cm (0.75 in).

8. The apparatus recited in claim 5 wherein a generally arcuate path is formed between said underside of said blade member and said active face of said liquid deflector member.

9. The apparatus recited in claim 5 wherein a generally obtuse angular path is formed between said underside of said blade member and said active face of said liquid deflector member.

* * * * *